US006230329B1

(12) United States Patent
Jennings

(10) Patent No.: US 6,230,329 B1
(45) Date of Patent: May 15, 2001

(54) INVALID SUPPORT GARMENT

(76) Inventor: Barbara Jennings, 223 Streets Run Rd., Pittsburgh, PA (US) 15236

( * ) Notice: Subject to any disclaimer, the term of this patent is extended or adjusted under 35 U.S.C. 154(b) by 0 days.

(21) Appl. No.: 09/528,234

(22) Filed: Mar. 17, 2000

Related U.S. Application Data

(60) Provisional application No. 60/125,398, filed on Mar. 22, 1999.

(51) Int. Cl.[7] ..... A41D 1/00
(52) U.S. Cl. ..... 2/114
(58) Field of Search ..... 2/114, 69.5, 75, 2/78.1, 78.2, 80, 83, 111, 109, 113, 312, 400, 402, 407, 408

(56) References Cited

U.S. PATENT DOCUMENTS 1,050,934 * 1/1913 Fanta .
1,805,766 * 5/1931 Groves .
2,067,870 * 1/1937 Blackwell ..... 2/78
3,564,616 * 2/1971 Battaglia ..... 2/311
3,997,921 * 12/1976 Knight ..... 2/75
4,396,013 * 8/1983 Hasslinger ..... 128/133
4,429,419 * 2/1984 Snyder ..... 2/102
4,599,750 * 7/1986 Rahaman ..... 2/243
4,625,334 * 12/1986 Proffer ..... 2/1
5,048,122 * 9/1991 Prieur ..... 2/69
5,065,773 * 11/1991 Jackson et al. ..... 128/876
5,619,751 * 4/1997 Ray et al. ..... 2/102
5,718,189 * 2/1998 Blake ..... 119/770
5,799,328 * 9/1998 Harlem et al. ..... 2/69
5,926,846 * 7/1999 Segal ..... 2/102
6,058,513 * 5/2000 Simmons et al. ..... 2/312

* cited by examiner

*Primary Examiner*—John J. Calvert
*Assistant Examiner*—Alissa L. Hoey
(74) *Attorney, Agent, or Firm*—J. Stewart Brams

(57) ABSTRACT

A garment with handholds and a design and structure adapting it to be worn by an invalid person to facilitate necessary moving of the wearer by caregivers with minimal discomfort and risk of injury to both.

11 Claims, 2 Drawing Sheets

INVALID SUPPORT GARMENT

RELATED APPLICATION DATA

This application relies on prior provisional application No. 60/125,398, filed Mar. 22, 1999, for its effective filing date and all other applicable purposes.

BACKGROUND OF THE INVENTION

Continuing improvements in health care, lifestyles, and public and occupational safety are increasing the longevity of individuals. These factors, plus the advancing age of the "baby boom" generation, are combining to create a rapidly growing aged population with attendant massive increases in the health care needs of that population. A proportionate share of the resulting health care needs are those of persons who, for various reasons, require physical assistance in moving.

Any person, and especially an aged one, who requires physical assistance to move presents a difficult problem for caregivers. A bedridden patient may need to be turned frequently or shifted in bed. Regular assistance in moving from the bed to a chair may also be required, as well as assistance in standing and walking, and helping the patient in the use of a bathroom commode. The skin of an aged person can be very fragile and tender, and easily subject to superficial trauma such as bruising. Discomfort and trauma may result not only from the physical contact required for a caregiver to assist an invalid in moving, but additionally from the localized pressure on the invalid's body where there is contact with structural features of conventional implements or garments intended to facilitate the moving chore. Bed sores may result if a bedridden patient is not turned often enough due to the difficulty of the chore. Without proper assistance, injuries from falls, bone fractures for example, will occur more frequently. An aged invalid may often be so completely unable to self-motivate that moving them is essentially a chore of moving a mass of dead weight that is simultaneously limp, bulky and fragile.

Caregivers also risk physical injury in performing the lifting required to assist invalids. The invalid may be limp and unresponsive, or agitated and uncooperative, or merely independent enough that the invalid and the caregiver are working at cross purposes. Any of these factors, and others, can complicate the caregiver's chore and increase the risk of injury.

Of course, those requiring physical assistance in moving are not limited to the aged. Invalids are found in every population age group. Moreover, those filling the role of caregiver are not limited to nursing home staff. In the home care environment, the primary caregiver may often be a family member who is not well trained or experienced in techniques for physically assisting an invalid.

For these among many other reasons, various devices have been proposed to provide improved ease, safety and comfort for both patient and caregiver in performing necessary patient moving chores. For example, the following patents disclose a variety of such devices: U.S. Pat. Nos. 4,449,253, 5,647,378, 5,361,418, 5,369,804, 5,542,123, 5,514,019, 5,546,602, and 3,562,812.

BRIEF SUMMARY OF THE INVENTION

The present invention contemplates a garment to be worn by any person requiring physical assistance in moving. The garment, which is worn over the clothing, is made from a light weight, preferably non-stretching fabric, and is preferably configured to enclose the torso of the wearer in form-fitting fashion. Handholds located at selected positions on the garment permit a caregiver to easily grip the garment and to apply the necessary force for moving or shifting the wearer. The caregiver thus can perform the moving chore without having to grasp and pull the patient's arms, legs, shoulders or hips. The garment is structured to distribute forces, which result from the caregiver performing the moving chore through use of the handholds, over an enlarged area of the wearer's body, thereby avoiding localized force concentrations on the body and minimizing bruising, abrasion and other modes of localized trauma that can lead to wearer discomfort.

The invention can contribute in many positive ways to a user's well being. It provides improved ease, safety and control for both patient and caregiver, and abates the incidence of injury to both. Patient fear can be alleviated. The incidence of bruising, fractures, bed sores and pneumonia can be reduced. Patient circulation, mood, outlook and overall well being can be improved. For the caregiver, the invention saves time and space, and offers improved control, balance and confidence in managing the invalid. In many cases the invention may eliminate the need for an adjustable hospital bed. Moreover, institutional placement can be delayed or eliminated if patient assistance in moving is a significant barrier to home care. This can result in significant savings to insurance providers and government medical plans, thus offering the prospect of reduced costs to premium payers and taxpayers.

OBJECTS OF THE INVENTION

It is therefore an object of the invention to provide a novel and improved garment for facilitating the rendering of physical assistance to the wearer.

Another object of the invention is to provide such a garment with handholds for facilitating such physical assistance.

A further object of the invention is to provide such a garment which minimizes both wearer discomfort and the caregiver's risk of injury in the process of rendering physical assistance to the wearer.

BRIEF DESCRIPTION OF THE DRAWINGS

These and other objects of the invention will be more readily appreciated upon consideration of the following detailed description and the accompanying drawings, in which.

DESCRIPTION OF THE PREFERRED EMBODIMENT

Figure 1:
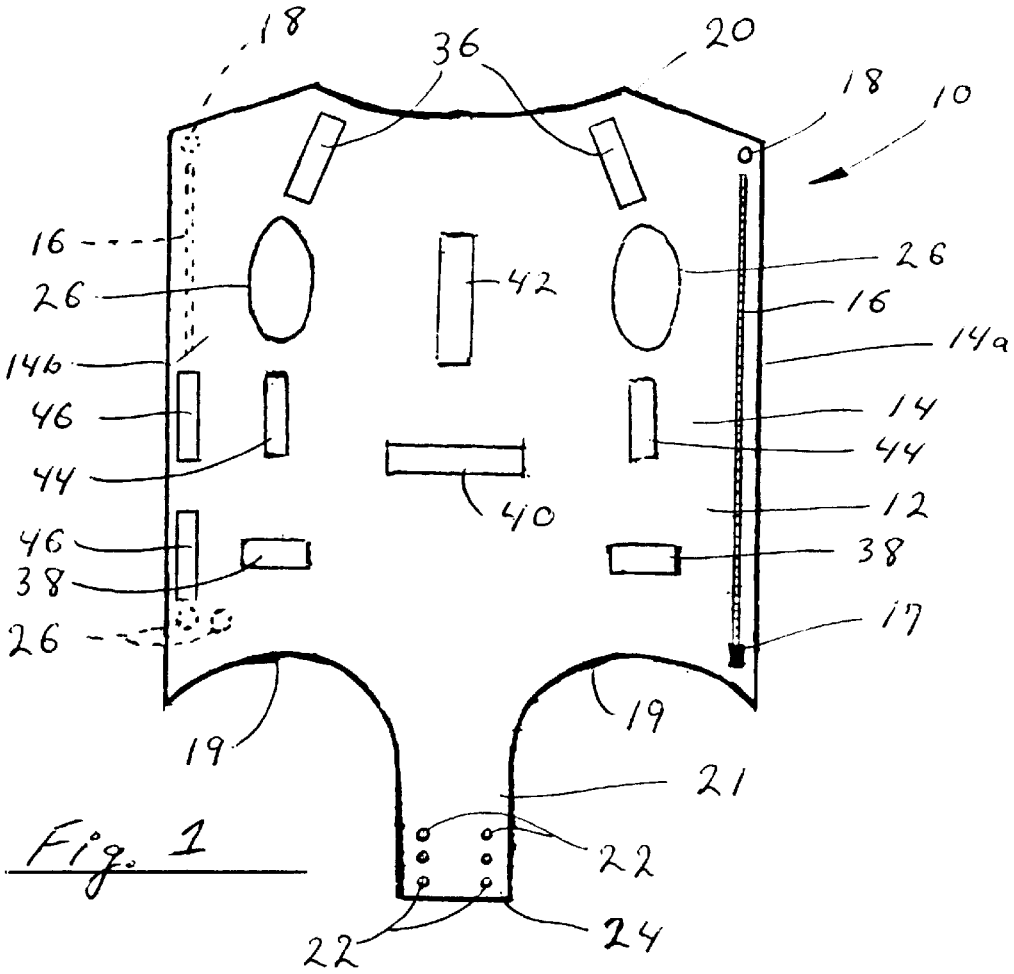
FIG. 1 shows a garment of the present invention spread open and laid flat.

There is generally indicated at 10 in FIG. 1 a garment according to one presently preferred embodiment of the invention. Garment 10 is comprised of an expanse of fabric 12 having characteristics as described hereinbelow. Depending upon the specific character of the fabric 12 to be used, garment 10 is suitably constructed to the pattern of FIG. 1.

If the fabric used can stretch and deform sufficiently in the plane of the fabric expanse to suitably conform to the wearer's body, the garment may be cut from a single expanse of fabric. In the alternative, if the fabric used is non-stretching or stretches in only one direction, the garment may be sewn up from fabric pieces cut to provide proper fit of the garment over the contours of a wearer's body in accordance with conventional garment cutting and sewing practice of the tailoring trade. Although specific features of the desired fit will be discussed hereinbelow, in general the cut of the upper portion of garment 10 may correspond to that of a vest, and the lower part to that of a semi-fitted underwear or foundation brief.

Figure 3:
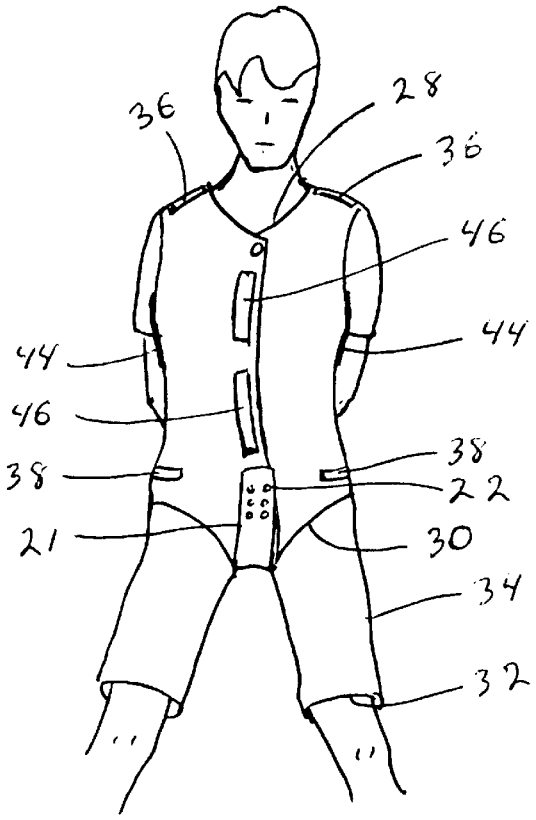
FIG. 3 shows a frontal view of the garment being worn by a person, and, FIG. 4 shows a rear view of the garment being worn by a person.

Garment 10 includes a main body portion 14 which horizontally encloses the torso of the wearer and is retained by bringing together the opposed lateral sides 14*a* and 14*b* of body portion 14 so that they overlap and extend vertically along the central chest, abdomen and hip areas of the wearer as shown in FIG. 3. To secure the garment, a frontal closure such as a zipper 16 is suitably secured adjacent the lateral edges of sides 14*a* and 14*b*, and runs vertically along essentially the entire frontal length of the garment. In addition to zipper 16, a suitable top closure 18 such as a snap or clasp may be provided adjacent to the neckline 20 of the garment 10 for added security of the front closure and to provide additional secure retention for the slide 17 of zipper 16. As shown, edge 14*a* provides a sufficient expanse of underlap to ensure that no part of the zipper 16 can contact the wearer's body, especially at the ends of the zipper.

An elongated tail flap 21 extends downward centrally from a lower extremity of body portion 14 centrally between leg cutouts 19. Flap 21 includes a suitable adjustable closure such as a plural pairs of snaps or clasps 22 located in spaced apart relation along a line extending from the free end 24 of flap 21. The closure pairs 22 mate with cooperating closure elements 26 located to be positioned centrally of the lower, frontal aspect of garment when donned by a wearer. The fit of the garment is adjusted, as deemed appropriate for its purpose, by selecting for use one or another of the closure pairs 22.

The garment 10, as described, will be provided in a variety of sizes, generally corresponding to conventional off-the-rack clothing sizes for example, to fit a variety of patient body sizes and proportions. The desired fit generally will be snug, but not tight, binding or constricting.

To put on the garment 10, the wearer inserts the arms through a pair of armholes 26 with the garment 10 behind, as though putting on a robe. Closures 16 and 18 are secured, and the free end 24 of flap 21 then is brought under the crotch from back to front and the closure elements 22 and 26 secured to provide the desired degree of taughtness. When being worn, the garment appears as in FIGS. 3 and 4. As shown there, the garment 10 may be worn over various types of conventional outer or underclothing. It may also be worn under a hospital gown or a conventional gown that has been suitably modified, for example by being cut to provide a vertically extending opening in back along at least a lower part of the gown, from the hem to the waist for example. The caretaker would reach under the gown to grip the handholds of the garment 10.

Figure 4:
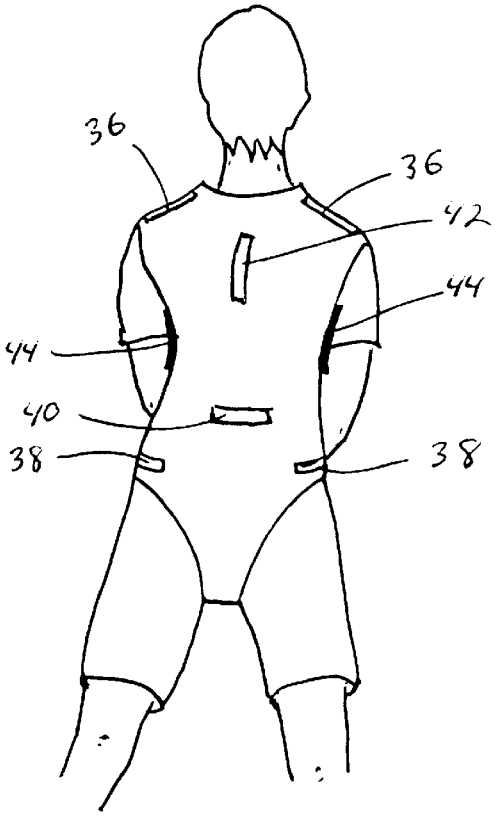

Features of the garment fit, as shown in FIGS. 1, 3 and 4, include the following. In overall fit, the garment 10 is form-fitting but not tight or constricting. The neckline 20 is configured to form a sufficiently low cut v-neck 28 in front that the garment cannot ride up and apply pressure in the wearer's neck region. The armholes 26 are oversized, especially below the armpits, in order to prevent similar pressure application or binding under the arms. The leg openings, formed when the flap 21 is brought around the crotch and fastened, preferably are not cut high and the buttocks and hips preferably are fully covered. In an alternative leg configuration, the garment 10 may include leg portions having a length anywhere between the lower terminus 30 of garment 10 as shown in FIG. 3, and the lower terminus 32 of shorts 34, also shown in FIG. 3. With such an alternative leg configuration, the garment 10 will include sewn-up leg portions, or a corresponding pattern and additional closures similar to those described above for enclosing the leg portions about the wearer's legs.

A plurality of handholds are suitably fixed to or formed integrally with garment 10 to provide convenient points for grasping by a caregiver to assist in shifting or moving the wearer. The preferred handhold locations include a pair of horizontally disposed handholds 38 at laterally opposed locations on the hips, a horizontally disposed handhold 40 at the lower spine, a vertically disposed handhold 42 at the upper spine, a pair of vertically disposed handholds 44 at laterally opposed sides of the chest under the arms, a pair of vertically disposed and vertically spaced handholds 46 disposed centrally on the frontal aspect of the torso, and a pair of shoulder handholds 36 extending between the upper extent of each armhole 26, respectively, and the corresponding, adjacent portion of the neckline 20.

Details of construction for the garment 10 should account for a variety of considerations. The material from which the main body 14 of garment 10 is formed should be a material which will distribute the pulling loads originating at the handholds, that will be form-fitting without binding, and that will provide suitable ventilation. The material should preferably also be supple and smooth textured to the touch rather than rough or coarse. It should exhibit no significant stretching under load, at least in the lengthwise direction of the garment and preferably in all directions. This means, in turn, that depending on the stretch properties of the fabric used, the orientation of the garment pattern on the fabric, with respect to the stretching properties of the fabric in the lateral versus the longitudinal direction, may require close attention. Suitability for regular laundering is yet another fabric selection limitation to be considered. Supplex (™) brand fabric produced by Burlington Industries is one example of a suitable fabric for the garment 10. It is a 100 percent nylon material, essentially non-stretch, with a cotton hand or feel.

Skin health is a significant issue. As noted above, the skin of an elderly patient can be very fragile. Any point of thickness on the garment is a potential pressure point, and hence a potential source of superficial skin trauma. It is therefore preferred that the material used for the garment 10 be a fabric requiring no edge finishing, including cut edges. Multiple layers of fabric should be avoided to the extent possible in construction of the garment. The described handholds, for example, may be constructed from available nylon strapping that is both very thin and supple, and very strong. Finishing of cut ends on such strapping may involve no more than running the cut end past an open flame to melt and fuse the cut fibers. Given the high strength of available strapping, the need for mass or bulk in strapping material to provide the requisite strength is greatly reduced.

Figure 2:
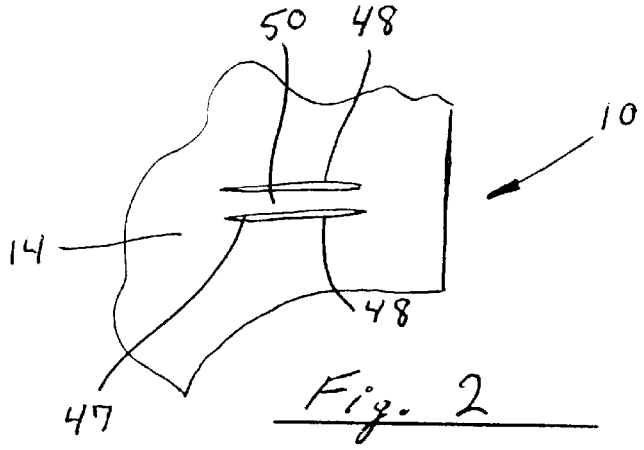
FIG. 2 shows a fragmentary portion of the garment of FIG. 1 with an alternative structure for a handhold portion of the garment.

Another structural alternative that can significantly reduce the bulk or thickness of the handholds, and hence the pressure points created thereby, is to form each handhold as shown at 47 in FIG. 2 by cutting a pair of parallel slits 48 in the fabric body 14 of garment 10. The slits 48 may be the same length as the previously described handholds; that is, of sufficient length to permit an adult hand to readily pass through them. The fabric remaining between the pair of slits 48, indicated at 50, forms a handhold which a caregiver may grasp in exactly the same manner as one would grasp a sewn-on or otherwise attached handhold. Unlike such a sewn-on handhold, however, the handhold structure of FIG. 2 adds no bulk, stiffiess or thickness to the structure of the garment 10. It is to be noted that forming the handhold structure 47 requires no removal of material whatever from the fabric body 14, since the openings forming the handhold are slits and not cutouts or holes.

If binding is required along the garment edges, a Lycra (™) and nylon knit stretch fabric may serve. This will provide a smoother, thinner and more comfortable edge than conventional bias tape.

It will be appreciated that the invention is not limited to the structural details of the described preferred embodiment. The fabric used for the garment may be chosen from a range of alternatives with suitable characteristics of strength, stretch and comfort. Other than the fabric choices already mentioned, Cordura (™) or other performance or activewear fabrics, such as polyester mesh, duck cloth or pack cloth may be suitable. The same applies to the closures and fasteners used, which may also be chosen from a range of suitable alternative devices. The overall pattern or form of the garment may be varied, consistent with the fit and comfort concerns addressed above, to provide a suitable garment for a wide variety of body shapes, sizes and proportions. For example, the crotch area of the tail flap may be suitably gathered for fullness as necessary to accommodate the male anatomy without binding or constricting, or for patients wearing a thick diaper. In addition, the cut of the neck opening and arm holes may be varied as necessary to provide a non-constricting and non-binding fit.

The handholds may be any of a variety of alternative structures other than those described, consistent with the described strength and comfort concerns. For example, the garment may include continuous strips of webbing extending vertically along the front closure margins, the webbing being tacked in place at intervals to form a plurality of adjacent handholds. In addition, the handholds may be trimmed with suitable binding or piping for comfort of use and reinforcement. The handhold locations also may also be varied, consistent with described comfort and utility concerns.

In addition, in the manufacture of the garment some or all of the cut edges of the cloth may be finished to the outside of the garment rather than the inside to thereby provide a smoother inside surface and increased wearer comfort. For example, any cut edge which is finished by being folded to the outside of the garment, which is the opposite of usual garment construction practice, can offer enhanced wearer comfort.

These and other alternatives and modifications would occur to others versed in the art, once apprised of my invention. Accordingly, it is intended that the invention should be construed broadly and limited only by the scope of the claims appended hereto.

I claim:

1. A garment comprising:

a unitary body comprised of an expanse of thin, flexible material, said unitary body having an upper margin, a lower margin, and spaced apart lateral margins extending between said upper and lower margins;

said unitary body having a pair of arm holes disposed generally adjacent said upper margin;

mutually cooperable closure means disposed along said lateral margins, respectively, for securing said lateral margins adjacent each other when brought together as when enclosing said unitary body about a wearer's torso, whereby said upper margin forms a neck opening and said lower margin forms a leg opening;

said unitary body further including a plurality of handholds disposed at selected locations thereon for grasping by a person to assist a wearer of said garment in moving and;

at least some of said handholds comprising pairs of spaced apart openings in said flexible material of said unitary body, wherein said pairs of spaced apart openings are comprised of respective pairs of elongated slots formed essentially without removal of material from said unitary body said handfolds located at various regions including front and back portions of the unitary body.

2. The garment as set forth in claim 1 wherein said lower margin includes an elongated tail flap and first fastener means fixed thereto which are engageable with cooperable second fastener means disposed adjacent a lower end of at least one of said lateral margins, whereby plural leg openings are formed from said leg opening when said lateral margins are disposed adjacent each other and said first and second fastener means are engaged.

3. The garment as set forth in claim 1 wherein said plurality of handholds includes at least one handhold disposed adjacent a shoulder area of said unitary body when donned by a wearer.

4. The garment as set forth in claim 1 wherein said plurality of handholds includes at least one handhold disposed adjacent a side area of said unitary body when donned by a wearer.

5. The garment as set forth in claim 1 wherein said plurality of handholds includes at least one handhold disposed adjacent a hip area of said unitary body when donned by a wearer.

6. The garment as set forth in claim 1 wherein said plurality of handholds includes at least one handhold disposed adjacent a lower back area of said unitary body and at least one handhold disposed adjacent an upper back area of said unitary body when donned by a wearer.

7. The garment as set forth in claim 1 wherein said plurality of handholds includes at least one handhold disposed adjacent a central frontal area of said unitary body when donned by a wearer.

8. The garment as set forth in claim 1 wherein said plurality of handholds includes, when said unitary body is donned by a wearer, at least one handhold disposed adjacent a shoulder area of said unitary body, at least one handhold disposed adjacent a side area of said unitary body, at least one handhold disposed adjacent a hip area of said unitary body, at least one handhold disposed adjacent a lower back area of said unitary body, at least one handhold disposed adjacent an upper back area of said unitary body, and at least one handhold disposed adjacent a central frontal area of said unitary body.

9. The garment as set forth in claim 1 including cut edges of said material in the construction thereof, and at least some of said cut edges are finished to the outside of said garment.

10. In a garment having at least portions made of an expanse of thin, flexible material and having handholds thereon for grasping by a person to assist a wearer of the garment in moving, the improvement comprising:

at least some of said handholds comprising pairs of spaced apart openings in said flexible material of said garment, wherein said pairs of spaced apart openings are comprised of respective pairs of elongated slots formed essentially without removal of material from said garment said handholds located at various regions including front and back portions of the garment.

11. The improvement as set forth in claim 10 wherein said pairs of spaced apart openings are elongated, parallel slots in said flexible material formed by cutting said expanse of flexible material essentially without removing any material therefrom.

* * * * *